US006354306B1

(12) United States Patent
Russell

(10) Patent No.: US 6,354,306 B1
(45) Date of Patent: Mar. 12, 2002

(54) METHOD AND APPARATUS FOR A PONYTAIL HOLDER DEVICE

(76) Inventor: Genita Russell, P.O. Box F43944, Freeport (BS)

( * ) Notice: Subject to any disclaimer, the term of this patent is extended or adjusted under 35 U.S.C. 154(b) by 0 days.

(21) Appl. No.: 09/532,014

(22) Filed: Mar. 21, 2000

Related U.S. Application Data

(63) Continuation-in-part of application No. 09/410,985, filed on Oct. 1, 1999.

(51) Int. Cl.[7] ..... A45D 8/36
(52) U.S. Cl. ..... 132/273; 132/200
(58) Field of Search ..... 132/200, 201, 132/212, 273, 53, 277, 222, 210, 275; D28/39, 40, 41; D11/20

(56) References Cited

U.S. PATENT DOCUMENTS

| | | | | | |
|---|---|---|---|---|---|
| 894,762 | A | | 7/1908 | Taylor | |
| 1,493,219 | A | * | 5/1924 | Murmann | 132/201 |
| 2,765,798 | A | | 10/1956 | Carvell | 132/55 |
| 3,229,308 | A | | 1/1966 | Jensen | 2/171 |
| 3,724,470 | A | * | 4/1973 | Wilson | 132/53 |
| 4,785,834 | A | * | 11/1988 | Gonzalez | 132/273 |
| 4,966,173 | A | * | 10/1990 | Russell | 132/273 |
| 5,293,884 | A | * | 3/1994 | Chapman et al. | 132/200 |
| 5,303,723 | A | | 4/1994 | Schach | 132/246 |
| 5,494,059 | A | | 2/1996 | Barrows et al. | 132/273 |
| D374,758 | S | | 10/1996 | Armenta et al. | |
| 5,575,298 | A | * | 11/1996 | Hinton | 132/200 |
| 5,730,161 | A | | 3/1998 | Kohanek | 132/273 |
| 5,769,101 | A | | 6/1998 | Iwata | 132/273 |
| 5,878,756 | A | | 3/1999 | Bilodeau | 132/274 |
| 5,893,376 | A | | 4/1999 | Glassberg | 132/273 |
| 5,899,211 | A | * | 5/1999 | Brown | 132/201 |
| 5,920,909 | A | | 7/1999 | Ellsworth et al. | 2/171 |
| 5,970,991 | A | | 10/1999 | Srivastava | 132/274 |

* cited by examiner

*Primary Examiner*—Pedro Philogene
(74) *Attorney, Agent, or Firm*—Oltman, Flynn & Kubler

(57) ABSTRACT

The present invention is a ponytail holder device and a method of manufacturing the ponytail holder device. More specifically, the ponytail holder device is to be used by the wearer to present a ponytail holder or to be formed into a ponytail onion that looks like the wearer's hair. The ponytail holder device to be easily incorporated into the user's hair style and positionable by the wearer in a variety of positions in order to facilitate different styles. The ponytail holder device and the method of manufacturing of the ponytail holder device and preformed ponytail onion are cost effective to manufacture.

2 Claims, 3 Drawing Sheets

NOTE

FIGURES 3(A—K) REPRESENT THE METHOD OF MANUFACTURE OF PONY TAIL ONION

ROLL INTO A CIRCLE ONE SLIGHTLY BIGGER THE SUBSTRATE STRIPS

APPLY TAPE TO THE TOP OF THE BIGGER CIRCLE OF SUBSTRATE

CUT A CROSS IN THE CENTER

PLACE A SMALL PAPER CIRCLE IN THE MIDDLE

CUSHION MATERIAL IS WRAPPED AROUND THE SIDES

SECURE HAIR DOWN THE CENTER

BRUSH HAIR OVER THE SHAPE

PLACE NETTING FIBRE ON THE INSIDE OF THE SMALLER CYLINDER

USE THE SMALLER CYLINDER TO SECURE THE HAIR ON THE INSIDE

ONION

METHOD AND APPARATUS FOR A PONYTAIL HOLDER DEVICE

This application is a continuation-in-part of U.S. Ser. No. 09/410,985, filed Oct. 1, 1999, now abandoned.

BACKGROUND OF THE INVENTION

1. Field of the Invention

The present invention relates to a ponytail holder device and a method of manufacturing such a device. More specifically, the ponytail holder device is for use by the wearer to present a ponytail holder. The ponytail holder can be preformed into a ponytail onion which may be presented on the wearer's head, thus enhancing the style of the wearer's hair, the ponytail holder device having the appearance of the wearer's hair. The ponytail holder device can be easily incorporated into the user's hair style and positionable by the wearer in a variety of ways in order to facilitate different styles. The ponytail holder device and the method of manufacturing such a device and preformed ponytail onion are cost effective to manufacture.

2. Description of the Prior Art

The use of ponytail holding, ponytail onion, or bun forming, devices and methods of manufacturing thereof have been known for many years. Such ponytail holding onion devices and methods of manufacturing have been used to enhance wearer's hair styles. Typically, the ponytail holding devices were made of an elastic type material that would be banded around the hair of the wearer to create a ponytail. In fact, the rubber band has been utilized to create ponytails for many years. The ponytail would then have to be meticulously formed into a ponytail onion. There have been other variations of the rubber band used to bind hair into a ponytail such as the use of ribbon. However, these methods had their limitations as to what the wearer could do to enhance the look of the ponytail and often required the use of additional fasteners, such as hair pins, to complete the hair styling. Otherwise, the banding methods would be visible in the wearers hair. The wearer would form a ponytail onion after fastening the ponytail and inevitably the ponytail onion created by the wearer would lose its shape.

U.S. Pat. No. 5,769,101 issued in 1998 to Iwata for a HAIR BUNDLING CORE AND METHOD OF USING THE CORE (hereinafter "Iwate") discloses a hair bundling core made of an elastic cylinder. While "Iwata" taught a device that would hold a ponytail, or bundle of hair, it specifically requires the use of hair fastening pins to create a ponytail onion. Moreover, the user of the "Iwata" device must use their own hair to cover the device and further fasten their own hair to cover the "Iwata" device. Heretofore each device used to create a ponytail onion, or further bundle hair, has required some masking of the method used to bundle the users hair or the bundling device would otherwise be visible in the wearers hair.

Other related patents suffer from the same limitations discussed above. For example, U.S. Pat. No. 5,494,059 issued in 1998 to Barrows for a HAIR STYLING IMPLEMENT AND METHOD (hereinafter "Barrows") discloses an elongated, rectangular wire frame covered by fabric. The "Barrows" device contemplates wrapping the wearer's hair around the implement. Likewise, U.S. Pat. No. 5,730,161 issued in 1998 to Kohanek for a METHOD AND APPARATUS FOR FORMING A HAIR FASTENER (hereinafter "Kohanek") discloses a hair fastening device which incorporates a hooking mechanism and discloses a long cylindrical shape that is meant to be used as a method to cover other fastening devices such as rubber bands. Also, U.S. Pat. No. 2,765,798 issued in 1953 to Carvell for a CHIGNON FOUNDATION (hereinafter "Carvell") discloses a device for forming and maintaining a hair roll for use by woman when they are arranging their hair and is constructed of a loose mesh. "Carvell" contemplates using the wearer's own hair and holding it in place by means of a mesh material. All of the aforementioned prior art requires additional fastening or the prior art is visible as a hair holding device on the wearer's head. In addition none of the prior art discloses a method of placing a perfectly formed ponytail onion on a wearer's head.

These patents do not, and cannot, resolve the problems addressed by the present invention. Even though the present invention addresses some of the same difficulties experienced in the art as does the prior patents, it does so in a new an inventive way. Moreover, the present invention embodies advantages never found or contemplated by the prior art which are described in greater detail below.

SUMMARY OF THE INVENTION

The use of ponytail holding devices, or bun forming devices, is well known. To date many of these ponytail holding devices, hair bundlers, and bun forming devices, are used to allow a wearer to create a ponytail, ponytail onion, or bun, as a hair desired style. The ponytail onion is a stylish addition to one's hairstyle.

While styling one's hair it is advantageous to be able to quickly apply a ponytail holder in a quick and effective manner. It is also advantageous to have a ponytail holder device that blends into ones own hair. Therefore, it is desirable to have a ponytail holder device that may placed on one's head and blend into the wearer's hair.

It is the object of this invention to provide a ponytail holding device that overcomes the limitations and faults of current ponytail holders, or hair bundlers when used by a wearer. A further object of this invention is to provide a ponytail holding device that can be utilized by a wearer.

Yet a further object of the invention is to provide a ponytail holding device that blends into a wearer's hair without further covering of the device with the wearer's own hair.

Still a further object of the invention is to provide a preform ponytail holding device that is shaped into a ponytail onion that will maintain its shape.

Another object of the invention is to provide an method for creating the ponytail holding device and ponytail onion contemplated herein.

It is still another object of this invention to provide a cost effective means of providing a ponytail holding device. Due to the nature of the use of a ponytail holding device, a ponytail holding device will degrade with use and become not usable over time. Therefore, it is important that materials that are task effective as well as cost effective be used in the construction of the ponytail holding device. As seen herein the material selection for the present invention is only limited by a few specific performance criteria but in the preferred embodiment of the invention material cost is also a selection criteria.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 1:
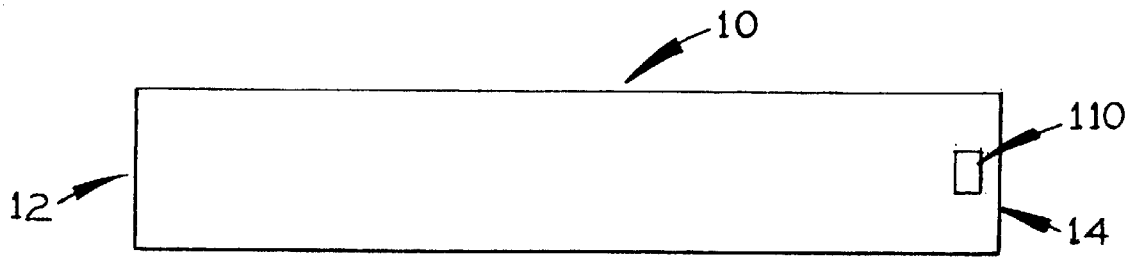
FIG. 1. represents the top view of the ponytail holding device.
Figure 2:
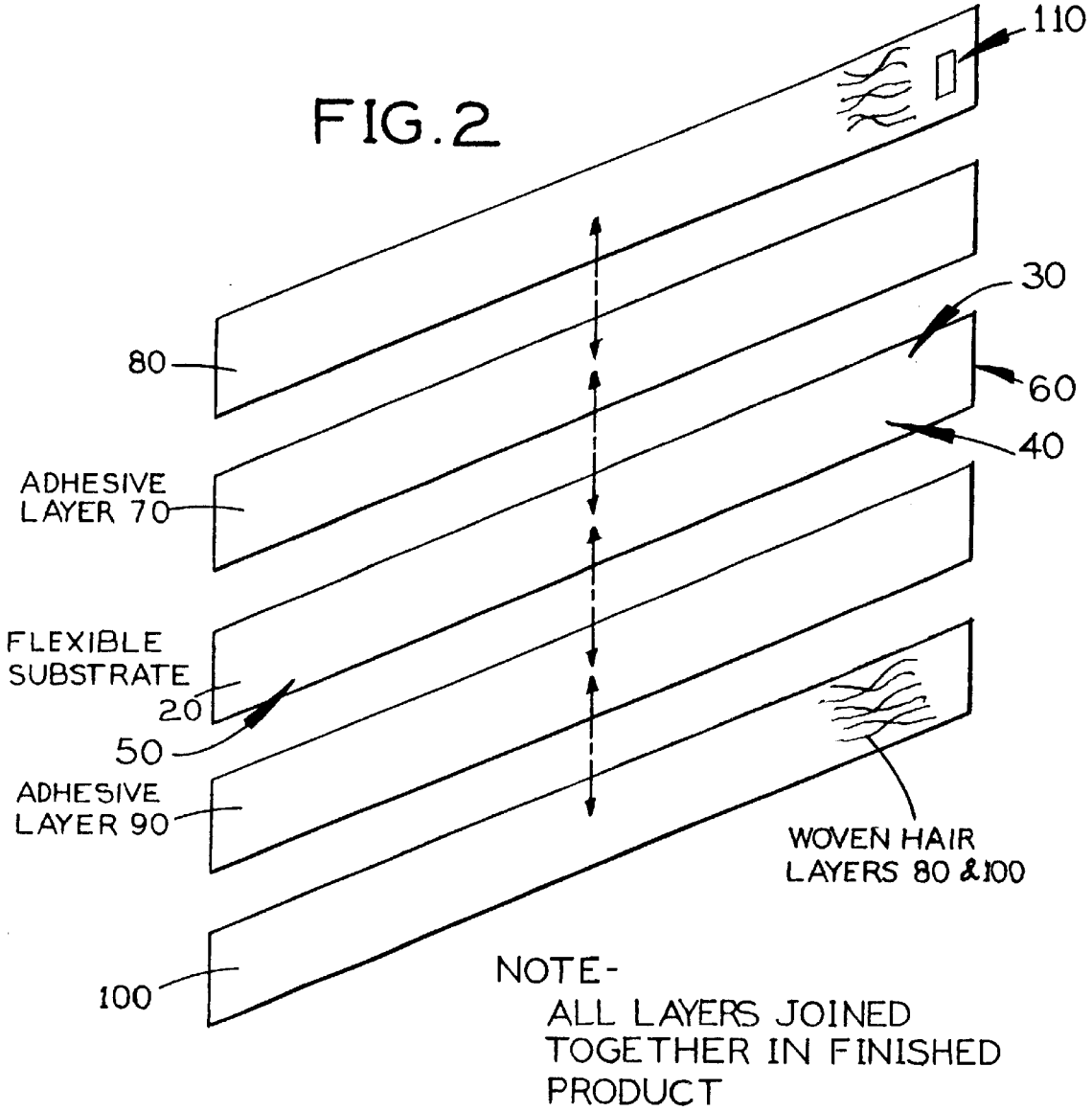
FIG. 2. represents an exploded view of the ponytail holding device.

Hereinafter the invention is described with particular reference to FIGS. 1, 2 and 3. A ponytail holder (10) for styling hair is shown in FIG. 1. Said ponytail holder has a first end (12) and a second end (14). The ponytail holder (10), in its preferred embodiment has a generally planar rectangular shaped flexible substrate (20) at its core. The flexible substrate has a first surface (30) and a second surface (40) and a first end (50) and a second end (60). A first layer of adhesive (70) is in adherence with the flexible substrate (20) on first surface (30) and is in opposite adherence with a first layer of artificial or cut natural hair (80). A second layer of adhesive (90) is in adherence with the flexible substrate (20) on second surface (40) and is in opposite adherence with a second layer of artificial or cut natural hair (100). Said flexible substrate (20), first layer of adhesive (70), said first layer of artificial or cut natural hair (80), said second layer of adhesive (90), and said second layer of artificial or cut natural hair (100) are substantially the same size and shape and together form the ponytail holder (10). Said ponytail holder (10) is flexible enough so that said first end (12) and second end (14) may be brought toward each other to form a cylinder as illustrated in FIG. 2.

Figure 3A:
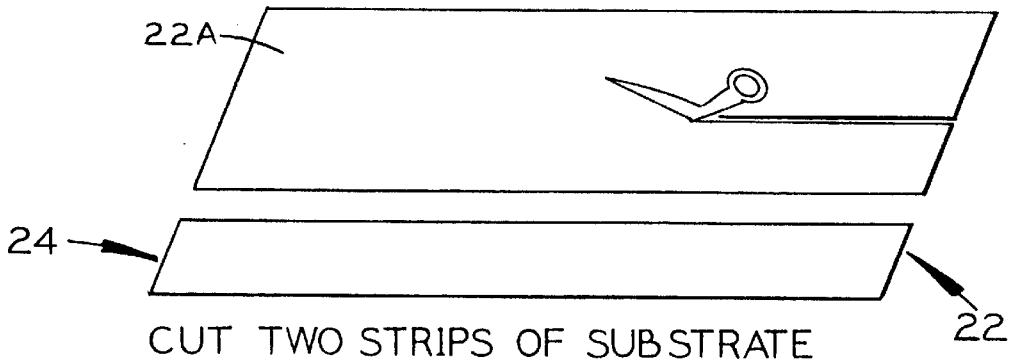
FIG. 3 (*a*)–(*k*). represents the method of manufacturing the ponytail holding device and ponytail onion.
Figure 3B:
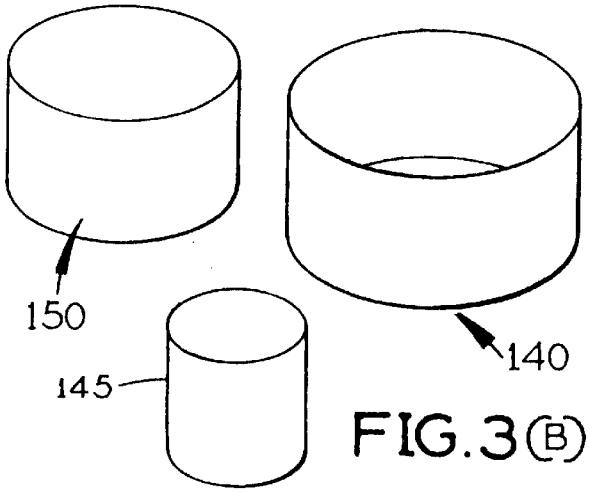
Figure 3C:
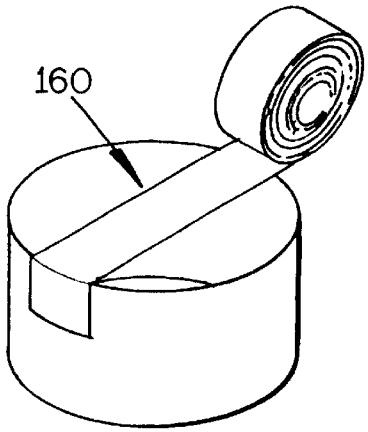
Figure 3D:
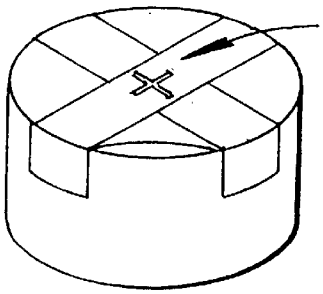
Figure 3E:
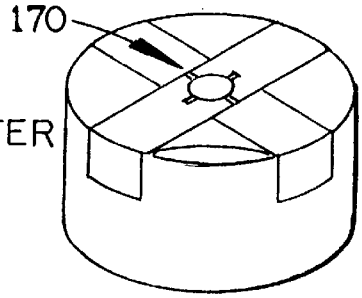
Figure 3F:
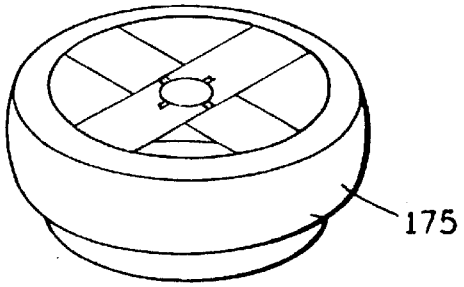
Figure 3G:
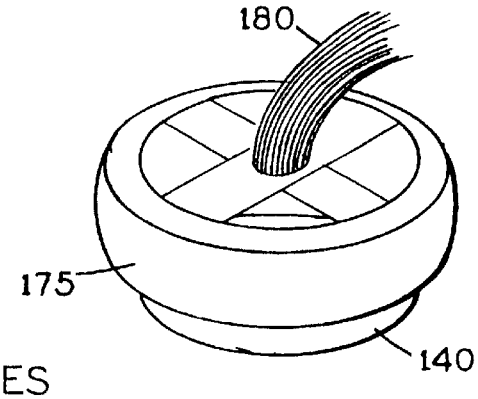
Figure 3H:
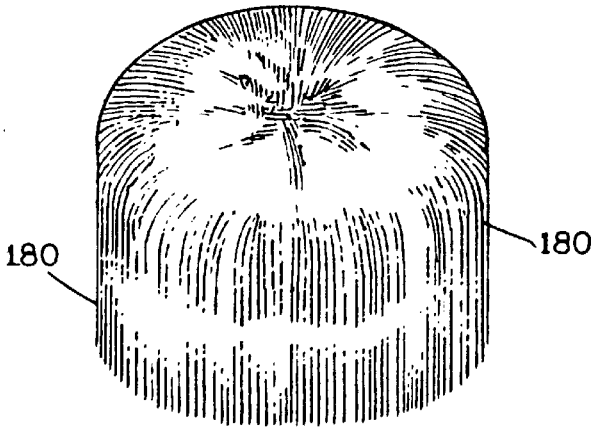
Figure 3I:
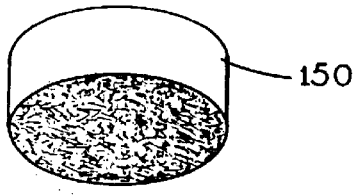
Figure 3J:
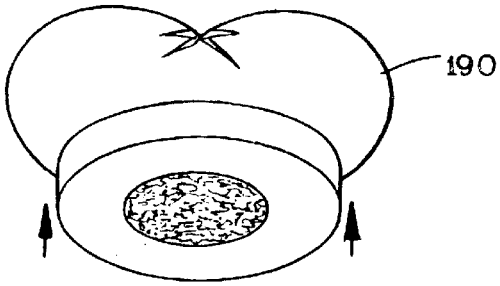
Figure 3K:
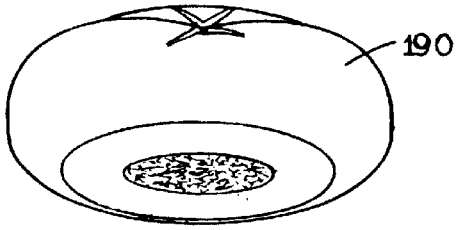

A second embodiment of the ponytail holder is described herein. A plain length of paper (20A) is cut and formed into a ponytail onion (130) as illustrated in FIG. 3(K). In this embodiment the generally planar flexible substrate (20A) has a first end (22) and a second end (24) as illustrated in FIG. 3(A). Said first end (22) and said second end (24) are brought towards each other and joined with adhesive to form a first cylinder (140) as illustrated in FIG. 3(B). A second cylinder (150) is formed form the same material as flexible substrate (20A). Said second cylinder (150) has a circumference smaller than said first cylinder (140) as illustrated in FIG. 3(B). A third cylinder (145) still smaller, is formed in the same way. Said first cylinder (140) has a cover (160) on one end as illustrated in FIG. 3(C). Said cover (160) further defines an opening (170) substantially centered on said cover (160) as illustrated in FIG. 3(E). The third cylinder is secured with adhesive inside the cover at the openings (170). A cushion material (175) is wrapped around the sides of the larger cylinder as shown (FIG. 3F). A bundle of hair (180) is secured down the center of the larger cylinder (140) as shown in FIG. 3. The bundle of hair (180) is evenly distributed around the first cylinder (140). A fibrous netting stuffing is inserted on the inside of the second cylinder and is secured with stitching as shown in FIG. 3(I). The second cylinder (150) is used to push the bottom ends of the hair into the inside of the larger cylinder where it is secured by stitching, as shown in FIG. 3(J). The hair is plumped out to the shape shown in FIG. 3 (K) to form what is called an onion (190) which is used as a hair piece.

The instant invention has been shown and described herein in what is considered to be the most practical and preferred embodiments. It is recognized, however, that departures may be made therefrom within the scope of the invention and that obvious modifications will occur to a person skilled in the art.

What I claim is:

1. A ponytail holder further comprising;

a flexible substrate at the core of said ponytail holder, said substrate having a first surface and a second surface;

a first layer of adhesive in adherence with said first surface;

a first layer of artificial or cut natural hair in adherence with said first layer of adhesive opposite said first surface of said flexible substrate;

a second layer of adhesive in adherence with said second surface;

a second layer of artificial or cut natural hair in adherence with said second layer of adhesive opposite said second surface of said flexible substrate;

a first end of said ponytail holder opposite a second end of said ponytail holder; and a means for joining said first end of said ponytail holder to said second end of said ponytail holder.

2. A method of manufacturing a ponytail holder comprising a flexible substrate at the core of said ponytail holder, said substrate having a first surface and a second surface, a first layer of adhesive in adherence with said first surface, a first layer of artificial or cut natural hair in adherence with said first layer of adhesive opposite said first surface of said flexible substrate, a, second layer of adhesive in adherence with said second surface, a second layer of artificial or cut natural hair in adherence with said second layer of adhesive opposite said second surface of said flexible substrate, a first end of said ponytail holder opposite a second end of said ponytail holder and a means for joining said first end of said ponytail holder to said second end of said ponytail holder, comprising the steps of:

forming said substrate and said layers of hair in a substantially planar rectangular shape;

joining said substrate and said layers of hair with said layers of adhesive; and, affixing said means for joining to said ponytail holder.

* * * * *